United States Patent [19]

Hayashi

[11] Patent Number: 4,515,124

[45] Date of Patent: May 7, 1985

[54] ENGINE CONTROL SYSTEM

[75] Inventor: Yoshimasa Hayashi, Kamakura, Japan

[73] Assignee: Nissan Motor Company, Limited, Yokohama, Japan

[21] Appl. No.: 460,494

[22] Filed: Jan. 17, 1983

[30] Foreign Application Priority Data

Jan. 21, 1982 [JP] Japan ..... 57-6600[U]
Feb. 5, 1982 [JP] Japan ..... 57-15756[U]

[51] Int. Cl.[2] ..... F02D 31/00

[52] U.S. Cl. ..... 123/324; 123/339; 74/859

[58] Field of Search ..... 123/327, 339, 324; 74/859

[56] References Cited

U.S. PATENT DOCUMENTS

| | | | |
|---|---|---|---|
| 3,338,111 | 8/1967 | Walker | 123/339 |
| 3,575,148 | 4/1971 | Walter | 123/339 |
| 3,581,852 | 6/1971 | Griffen | 123/339 |
| 3,603,297 | 7/1971 | Sherwin et al. | 123/327 |
| 3,855,975 | 12/1974 | Masaki et al. | 123/327 |
| 3,906,909 | 9/1975 | Garcea | 123/324 |
| 4,026,168 | 5/1977 | Kobayashi | 123/327 |
| 4,144,853 | 3/1979 | Maruoka | 123/339 |
| 4,192,202 | 5/1980 | Gospodar et al. | 123/327 |
| 4,321,900 | 3/1982 | Takeda | 123/339 |
| 4,354,465 | 10/1982 | Takeuchi | 123/339 |
| 4,364,347 | 12/1982 | Miyagi | 123/339 |
| 4,365,599 | 12/1982 | Ikeura | 123/339 |

FOREIGN PATENT DOCUMENTS

| | | | |
|---|---|---|---|
| 56-115829 | 11/1981 | Japan | 123/339 |
| 1316470 | 10/1969 | United Kingdom | 123/324 |
| 2012997 | 12/1978 | United Kingdom | 123/324 |
| 2051422 | 5/1980 | United Kingdom | 123/324 |

*Primary Examiner*—Ronald B. Cox
*Attorney, Agent, or Firm*—Schwartz, Jeffery, Schwaab, Mack, Blumenthal & Koch

[57] ABSTRACT

A control system for an internal combustion engine of a vehicle equipped with an automatic transmission, comprises a first device for detecting an operating parameter in relation to vehicle cruising, a second device for detecting an engine temperature, and a third device for lowering engine speed at the fully closed position of a throttle valve in response to the detected operating parameter and the detected engine temperature, thereby effectively reducing fuel consumption and engine noise without deterioration in engine running stability.

10 Claims, 4 Drawing Figures

ENGINE CONTROL SYSTEM

BACKGROUND OF THE INVENTION

1. Field of the Invention

This invention relates to an improvement in a vehicle equipped with an automatic transmission, and more particularly to a control system for an engine of a vehicle equipped with an automatic transmission which engine is so arranged that its idling engine speed is normally maintained slightly high.

2. Description of the Prior Art

In a vehicle equipped with an automatic transmission, an engine is mechanically connected through a torque converter with a transmission mechanism or planetary gear system. More specifically, the engine is connected to the pump impeller of the torque converter whose turbine runner is, in turn, connected to the transmission mechanism through a power input shaft and a forward clutch. Accordingly, when the automatic transmission is in a non-drive range in which the selector lever is in N (Neutral) or P (Park) position to release the forward clutch, the turbine runner of the torque converter rotates without connection to the transmission mechanism, together with the pump impeller driven by the engine. When the transmission is in a drive range in which the selector lever is in D (Drive), D2 (Second drive), D1 (First drive), or R (Reverse) position so as to disengage the forward clutch, the turbine runner is connected to the planetary gear system.

With the thus arranged automatic transmission, when the vehicle is at standstill and the transmission is in the drive range, i.e., the engine is operated at idling upon the transmission being in the drive range, the turbine runner of the torque converter is halting together with the planetary gear system. Then, the pump impeller stirs fluid within a converter chamber of the torque converter and consequently a considerable load is applied to the engine, thereby causing engine speed to lower so as to increase engine vibration while resulting in a possibility that the engine will halt. In view of the above drawbacks, hitherto in a vehicle equipped with an automatic transmission, the valve opening degree of the throttle valve at its fully closed position (at idling) is so set that the engine speed is slightly higher (usually, about 100 r.p.m.) than that in a vehicle equipped with a manual transmission.

However, the following problems have been encountered with the vehicle in which idling engine speed is uniformly increased as stated above: Even during coasting of the vehicle, i.e., vehicle cruising due to the force of inertia in which the automatic transmission is in the drive range and an acceleration pedal is not operated, the above-mentioned valve opening degree of the throttle valve at its fully closed position is maintained to increase the engine speed. As a result, in such coasting of the vehicle, engine speed is increased to consume unnecessary fuel while deteriorating the effect of engine braking.

Additionally, during idling of the engine in which the transmission is in the non-drive range, the turbine runner rotates without connection to the transmission mechanism and therefore idling engine speed is increased, thereby increasing fuel consumption while increasing engine noise.

SUMMARY OF THE INVENTION

A control system of the present invention is used for an internal combustion engine of a vehicle equipped with an automatic transmission. The control system comprises a first device for detecting an operating parameter in relation to vehicle cruising, a second device for detecting an engine temperature, and a third device for lowering engine speed at the fully closed position of a throttle valve in response to the detected operating parameter and the detected engine temperature. Accordingly, fuel consumption is effectively reduced while lowering engine noise without deterioration of engine running stability.

Preferably, the first device is for detecting a vehicle speed not lower than a predetermined level, thereby effectively preventing engine speed for unnecessarily rising and preventing the engine braking effect from deteriorating during coasing of the vehicle.

Otherwise, the first device is preferably for detecting the fact that the automatic transmission is in a non-drive range, thereby preventing engine speed at idling from unneccesarily rising during idling under the condition of the non-drive range of the automatic transmission.

BRIEF DESCRIPTION OF THE DRAWINGS

The features and advantages of the engine control system of the present invention will be more clearly appreciated from the following description taken in conjunction with the accompanying drawings in which like reference numerals designate the corresponding parts and elements, and in which.

DETAILED DESCRIPTION OF THE INVENTION

Figure 1:
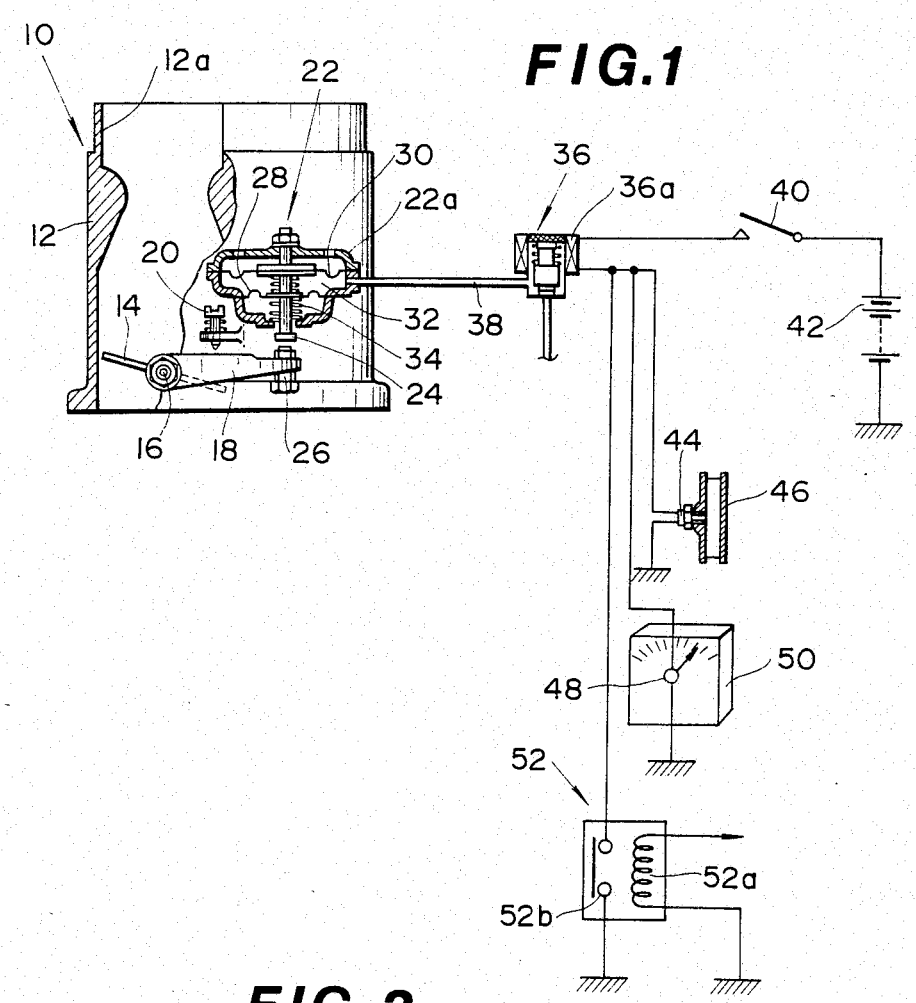
FIG. 1 is a schematic illustration of an embodiment of an engine control system in accordance with the present invention.

Referring now to FIG. 1 of the drawing, there is shown a preferred embodiment of a control system for an internal combustion engine equipped with an automatic transmission, in accordance with the present invention. In this embodiment, the engine is mounted on an automotive vehicle. The engine comprises a carburetor 10 formed in cooperation with an intake conduit 12 which defines therein an intake air passageway 12*a*. The intake air passageway 12*a* is in communication with combustion chambers (not shown) of the engine and provided therein with a throttle valve 14 which is mounted on a shaft 16 pivotally supported on the intake conduit 12. The throttle valve 14 is mechanically connected to an acceleration pedal (not shown) and arranged to rotate so as to change the air flow passage sectional area of the intake air passageway 12*a* in accordance with depression of the acceleration pedal. A lever 18 is secured to the throttle valve 14 so as to be rotatable with the throttle valve as a single member. The lever 18 is contactable at its central part with an adjustment screw 20 which is movably threaded in a projection (no numeral) forming part of the carburetor 10. This adjustment screw 20 functions to give a suitable rotatable displacement onto the throttle valve 14 by being screwed in or out, thereby suitably adjusting a throttle valve position to obtain a predetermined valve opening degree of the throttle valve 14. In this embodiment, with the thus set predetermined valve opening degree of the throttle valve 14, the engine speed becomes of a level corresponding to that at idling where the acceleration pedal is not depressed in a vehicle equipped with a manual transmission.

A vacuum actuator 22 is disposed in the carburetor 10 and has a push rod 24 which projects outwardly from a casing 22*a* and is contactable with a pin 26 which is threaded in a right end (in the drawing) of the lever 18. The push rod 24 is passed through and fixedly connected to a lower diaphragm 28 and further fixedly connected at its upper end with a upper diaphragm 30. The upper diaphragm 30 is larger in pressure receiving area than the lower diaphragm 28. The lower and upper diaphragms 28 and 30 are secured at their periphery to the casing 22*a*, maintaining air-tight seal, and defines a vacuum chamber 32 therebetween and in the interior of the casing 22*a*. Accordingly, when vacuum is introduced into the vacuum chamber 32, the push rod 24 is moved downwardly in the drawing to contact the pin 26 and push down the lever 18, thus causing the throttle valve 14 to rotate. This changes the fully closed position of the throttle valve 14 to the open side by a predetermined amount, i.e., from a first state to a second state. The valve opening degree at the second state is larger the predetermined amount than that at the first state. The valve opening degree of the throttle valve at the second state is so set as to cause the engine to run at an engine speed slightly higher (by a predetermined engine speed of about 100 r.p.m.) than the idling engine speed in an engine of a vehicle equipped with a manual transmission, in case the acceleration pedal is not operated or depressed as stated above. The vacuum actuator 22 is further provided with a spring 34 interposed between the lower diaphragm 28 and the bottom inner wall of the casing 22*a*. This spring 34 functions to urge upwardly the push rod 24 so as to separate the push rod 24 from the pin 26.

A three-way electromagnetic valve 36 is provided in a vacuum passage 38 connecting the vacuum chamber 32 of the vacuum actuator 22 with a vacuum source (not shown) such as an intake manifold, a vacuum tank or the like. The electromagnetic valve 36 has its solenoid 36*a* which is of the known type and energized to allow the vacuum chamber 32 to communicate with the vacuum source upon being supplied with electric current, while de-energized to allow the vacuum chamber 32 to communicate with the atmosphere upon being not supplied with electric current. The solenoid 36*a* of the electromagnetic valve 36 is provided with a terminal which is grounded through an ignition switch 40 and an electric source 42 which are electrically connected in series with the solenoid 36*a*. Another terminal of the solenoid 36*a* is grounded through an engine temperature switch 44, a vehicle speed switch 48, and a vacuum switch 52 which are electrically connected in parallel with the solenoid 36*a* and will be discussed in detail hereinafter.

The engine temperature switch 44 is disposed in an engine coolant passage 46 to detect the temperature of engine coolant flowing though the coolant passage 46. The temperature switch 44 is so arranged as to be open when the temperature of the engine coolant is not lower than a predetermined lever (for example, 70° C.) while be close when the engine coolant temperature is below the predetermined level.

The vehicle speed switch 48 is disposed in connection with a vehicle speed meter 50 and so arranged as to be open when the vehicle speed is not lower than a predetermined level (for example, 15 Km/h) while be close when the vehicle speed is below the predetermined level.

The vacuum switch 52 has a solenoid 52*a* which is electrically connected to a pressure sensor (not shown) for sensing vacuum within the combustion chamber of the engine. The vacuum switch 52 is arranged to be supplied through the pressure sensor with electric current to be energized when the vacuum within the combustion chamber increases over a predetermined level. Additionally, the vacuum switch 42 has a normally opened contactor 52*b* which is arranged to be close when the solenoid 52*a* is energized. The vacuum switch 52 is operable in connection with a fuel cutoff device or the like in order to reduce the fuel to be supplied to the carburetor 10 by a predetermined amount.

The operation of the thus arranged engine control system will be discussed hereinafter.

During vehicle cruising upon the automatic transmission being in a drive range where a selector lever is in D (Drive), D2 (Second drive), D1 (First drive), or R (Reverse) position, the throttle valve 14 has its valve opening degree corresponding to the depressed amount of the acceleration pedal so that the engine is supplied with air-fuel mixture in accordance with the acceleration pedal depression amount.

Now, when the vehicle speed is not lower than the predetermined level and the engine coolant temperature is not lower than the predetermined level, the temperature switch 44 and the vehicle speed switch 48 are both opened, so that solenoid 36*a* of the three-way electromagnetic valve 36 is not supplied with electric current to be de-energized. Accordingly, the vacuum chamber 32 of the vacuum actuator 22 is supplied with atmospheric air, so that the push rod 24 is moved upwardly in the drawing under the action of the spring 34, thereby separating the push rod 24 from the pin 36. As a result, under such a condition, during coasting of the vehicle where a driver releases or does not depress the acceleration pedal, the lever 18 is brought into contact with the adjustment screw 20, thus decreasing the valve opening degree of the throttle valve 14 at the fully closed position. The engine speed at the thus decreased valve opening degree of the throttle valve 14 approximately corresponds to that at idling in an engine of a vehicle equipped with a manual transmission. This effectively reduces the amount of consumed fuel and engine noise while greatly improving the effect of engine braking.

During vehicle cruising at a speed lower than the predetermined level, the vehicle speed switch 48 is close. Accordingly, the solenoid 36*a* of the electromagnetic valve 36 is supplied with electric current to be energized, so that the vacuum chamber 32 of the vacuum actuator 22 is brought into communication with the vacuum source. As a result, the push rod 24 moves downwardly in the drawing under the action of the lower and upper diaphragms 28 and 30. That is, when the vacuum is supplied to the vacuum chamber 32, the upper diaphragm 30 largely deforms as compared with the lower diaphragm 28 since the upper diaphragm 30 is larger in pressure receiving area or effective surface area than the lower diaphragm 28. As such, the push rod 24 fixedly connected to these diaphragms 28 and 30 displaces downwardly against the bias of the spring 34. Consequently, during vehicle cruising at such a speed lower than the predetermined level, when the driver releases acceleration pedal, the pin 26 of the lever 18 is brought into contact with the push rod 24, thereby increasing the valve opening degree of the throttle valve 14 at the fully closed position. Under the thus increased throttle opening degree, the engine runs at an engine speed slightly higher than the idling engine speed in the engine of the vehicle equipped with the manual transmission, thereby obtaining stable engine running while preventing misfire.

When the engine coolant temperature is lower than the predetermined level, the engine temperature switch 44 becomes close, thereby increasing the valve opening degree of the throttle valve 14 at the fully closed position or in case where the acceleration pedal is not depressed as same as in the above-mentioned case where the valve speed is below the predetermined level. As a result, a relatively high engine speed is maintained even when the acceleration pedal is not operated, thus causing the engine to stably run.

Furthermore, during vehicle cruising at a relatively high vehicle speed such as 50 Km/h or higher, when the vacuum actuator 22 operates to decrease the amount of air-fuel mixture to be supplied to the engine, the vacuum within the engine combustion chamber increases since the engine running is carried out together with wheels of the vehicle. The thus increased vacuum within the combustion chamber causes the pressure sensor to supply the solenoid 52*a* of the vacuum switch 52 with electric current in order to energize the solenoid 52*a*. As a result, the electromagnetic valve 36 allows the vacuum chamber 32 of the vacuum actuator 22 to be supplied with vacuum. Then, the push rod 24 of the vacuum actuator 22 moves downwardly in the drawing, and therefore the throttle valve 14 has the above-mentioned increased valve opening degree even when the acceleration pedal is not operated. Additionally, the above-mentioned pressure sensor is so arranged to operate the fuel cutoff device disposed in a fuel passage (not shown) leading to the carburetor 10, in addition to causing the vacuum switch 52 to operate. Accordingly, in this case, the engine is supplied with air containing the minimum fuel necessary for maintaining engine running, thereby preventing high vacuum from being generated within the combustion chamber while decreasing consumed fuel.

Thus, with this engine control system, when the vehicle speed is not lower than the predetermined level and engine temperature is not lower than the predetermined level, the amount of consumed fuel is reduced while preventing engine noise at idling from being generated; and when the vehicle speed is below the predetermined level or engine temperature is below the predetermined level, it is possible to obtain stable engine running while suppressing engine vibration as same as in an engine of a vehicle equipped with a usual automatic transmission.

Figure 2:
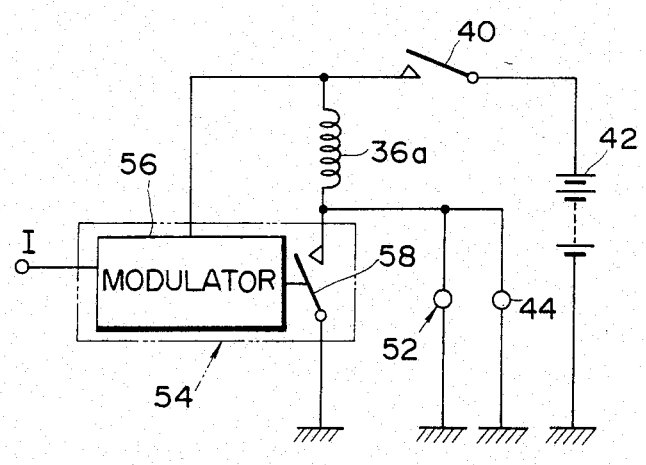
FIG. 2 is a circuit diagram of an essential part of a second embodiment of the engine control system in accordance with the present invention.

FIG. 2 shows another embodiment of the engine control system in accordance with the present invention, which is the same as the above-mentioned embodiment of FIG. 1 except for an engine speed switch 54. The engine speed switch 54 is used in place of the vehicle speed switch 48 in the embodiment of FIG. 1. The engine speed switch 54 includes a modulator 56 which is supplied with ignition pulse I in connection with the operation of an ignition system (not shown) of the engine. The modulator 56 is operatively connected to a normally closed contactor 58 which is arranged to be open when the ignition pulse supplied to the modulator 56 corresponds to an engine speed higher than a predetermined level. It will be understood that this embodiment operates as same as in the embodiment of FIG. 1.

Figure 3:
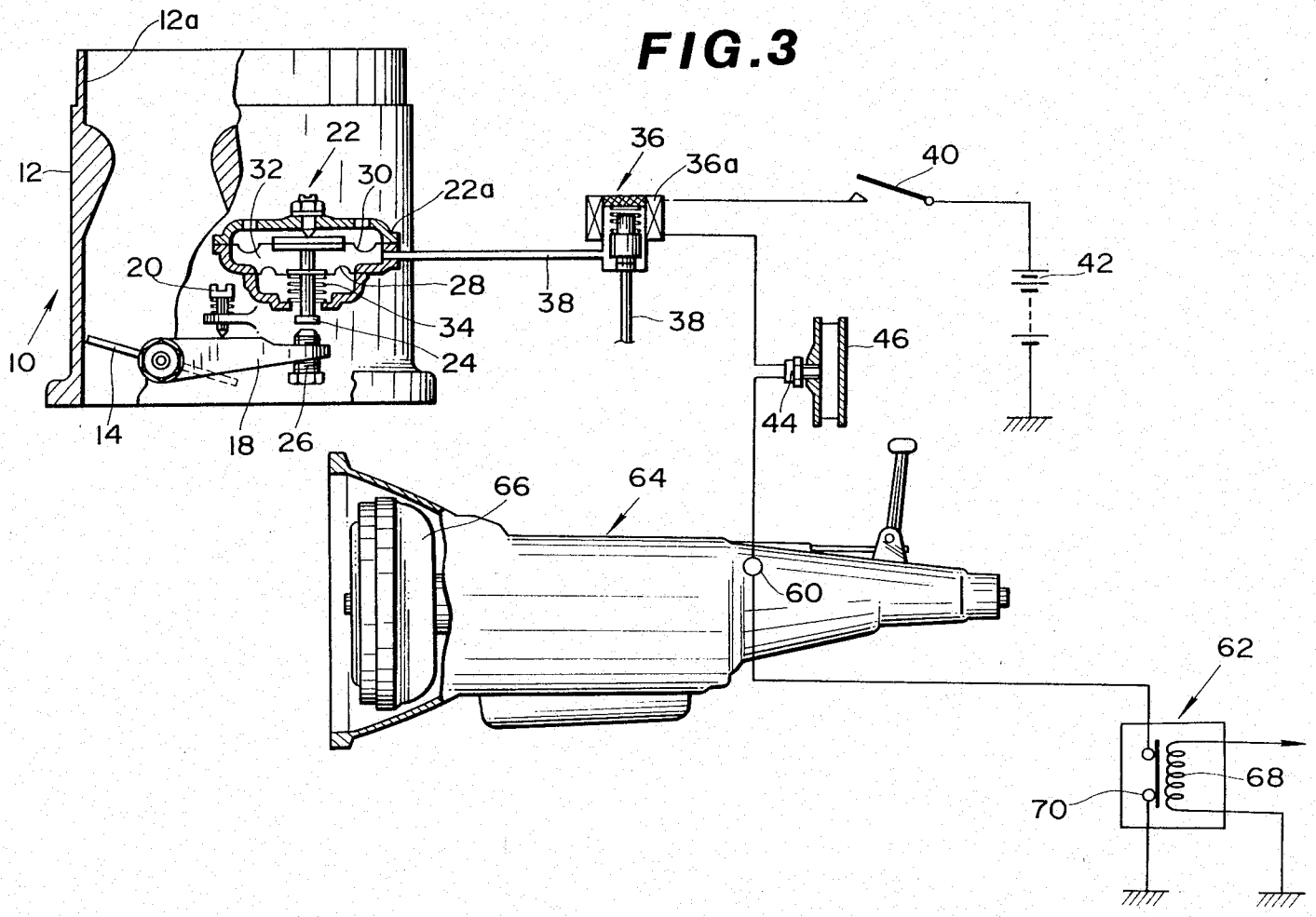
FIG. 3 is a schematic illustration of a further embodiment of the engine control system in accordance with the present invention.

FIG. 3 shows a further embodiment of the engine control system in accordance with the present invention. In this embodiment, the adjustment screw 20 functions to give a suitable rotatable displacement onto the throttle valve by being screwed in or out, thereby suitably adjusting a throttle valve position to obtain a predetermined valve opening degree of the throttle valve 14. In other words, the adjustment screw 20 sets the valve opening degree of the throttle valve 14 at the fully closed position or during idling where the acceleration pedal is not operated. The thus set fully closed position decides the engine speed at idling and gives the engine the idling engine speed which is slightly higher (about 100 r.p.m.) than that in an engine of a vehicle equipped with a manual transmission. Additionally, in this embodiment, the throttle valve 14 is arranged to rotate counterclockwise or in the closing direction by means of a gear mechanism (not shown) when the lever 18 is rotated in the clockwise direction. Furthermore, the engine temperature switch 44 is disposed in the coolant passage 46 which is connected to a radiator (not shown) or the like. This engine temperature switch 44 is so arranged as to be close when the temperature of the coolant passing through the coolant passage 46 is not lower than the predetermined level (for example, 70° C.), while to be open when the coolant temperature is below than the predetermined level.

One of terminals of the solenoid 36*a* of the three-way electromagnetic valve 36 is grounded through the temperature switch 44, a gear range switch 60 and a cranking switch 62 which are electrically connected in series with the solenoid 36*a*. The gear range switch 60 is disposed in operative connection with an automatic transmission 64 including a torque converter 66 through which the transmission mechanism of the automatic transmission is mechanically connected to the engine. The gear range switch 60 is so arranged as to be open when the automatic transmission is in the drive range in which the selector lever is in D, D2, D1 or R position, while to be close when the automatic transmission is in a non-drive range in which the selector lever is in P (Park) or N (Neutral) position.

The cranking switch 62 includes a solenoid 68 whose one terminal is electrically connected to a starter switch (not shown) and whose another terminal is grounded. The cranking switch 62 further includes a normally closed contactor 70 which is operated by the solenoid 68 and arranged to be open when the solenoid 68 is energized. Accordingly, the cranking switch 62 is to be open when the solenoid 68 is supplied with electric current to be energized during the operation of the starter switch.

In operation, when the automatic transmission 64 is in the non-drive range (N or P selector gear position ) and the engine coolant temperature is not lower than the predetermined level, the gear range switch 60 and the coolant temperature switch 44 are close. Consequently, the solenoid 36*a* of the three-way electromagnetic valve 36 is supplied with electric current from the electric source 42, thus causing the vacuum chamber 32 of the vacuum actuator 22 to be communicated through the vacuum passage 38 with the vacuum source. Then, the push rod 24 of the vacuum actuator 22 moves downwardly against the bias of the spring 34, thereby pushing down the lever 18. As a result, the throttle valve 14 slightly rotates in the closing direction, so that the fully closed position of the throttle valve 14 is changed into the more closed side, i.e., changed from the first state set by the adjustment screw 20 to the second state at which the valve opening degree of the throttle valve 14 is smaller than at the first state. It will be noted that the engine speed at the second state is lower by the predetermined engine speed than at the first state. Thus, the idling engine speed is lowered to the predetermined engine speed and becomes the same as in the engine of a vehicle equipped with a manual transmission. As such, when the automatic transmission 64 is in the non-drive range and the engine temperature is not lower than the predetermined level, the idling engine speed lowers, thereby reducing consumed fuel and engine noise under such an engine operating condition. Subsequently, when the automatic transmission 64 is in the drive range, the solenoid 36*a* of the three-way electromagnetic valve 36 is not supplied with electric current regardless of the operational condition of the temperature switch 44. Accordingly, the push rod 24 of the vacuum actuator 22 separates from the pin 26 of the lever 18 under the action of the spring 34, so that the lever 18 slightly rotates counterclockwise and be brought into contact with the adjustment screw 20. Then, the valve opening degree of the throttle valve 14 at the fully closed position becomes of a value set by the adjustment screw 20, thereby raising the engine speed at idling. This overcomes the conventional problem due to the fixed condition of the torque converter turbine runner.

Similarly, when the engine temperature is considerably low in which warming-up operation of the engine is necessary, the temperature switch 44 is open, so that the solenoid 36*a* of the three-way electromagnetic valve 36 is not supplied with electric current. Accordingly, the valve opening degree of the throttle valve 14 at the fully closed position is increased to raise the engine speed at idling. Additionally, when the coolant temperature is not lower than the predetermined level so that the temperature switch 44 is close while the automatic transmission 64 is in the drive range so that the gear range switch 60 is close, the valve opening degree of the throttle valve 14 at the fully closed position increases, thereby raising the engine speed at idling.

When the starter switch is close during engine starting, the solenoid 68 of the cranking switch solenoid 68 is supplied with electric current to be energized, thereby causing the contactor to be open. Consequently, the solenoid 36*a* of the three-way electromagnetic valve 36 is not supplied with electric current regardless of the state of the gear range switch 60. As a result, the valve opening degree of the throttle valve 14 at the fully closed position is increased to facilitate engine starting. Thus, cranking switch 62 is effective particularly in case of re-starting the hot engine in which the engine coolant temperature is not lower than the predetermined level.

Figure 4:
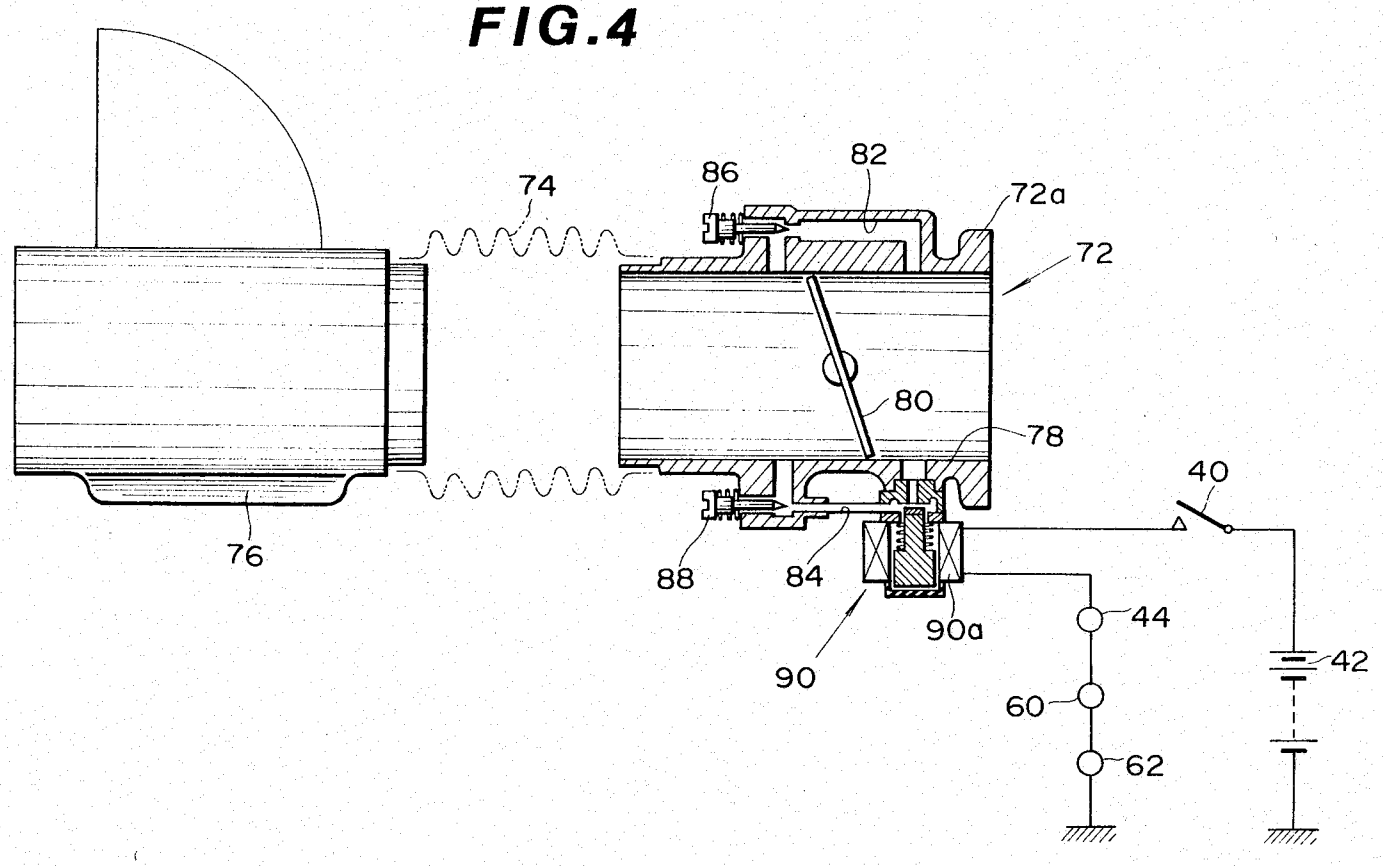
FIG. 4 is a schematic illustration of a further embodiment of the engine control system in accordance with the present invention.

FIG. 4 shows a further embodiment of the engine control system according to the present invention, in which the principle of the embodiment of FIG. 3 is applied to an engine of a vehicle equipped with an electronically controlled fuel injection system.

The engine is provided with an intake conduit 72 whose left end (in the drawing) is connected through a flexible tube 74 to an air flow meter 76, and whose right end (in the drawing) is connected to an intake manifold (not shown). The intake conduit 72 defines therein an intake air passageway 78 by the wall 72*a* thereof. A throttle valve 80 is pivotally disposed in the air passage 78. In the engine of the vehicle equipped with the electronically controlled fuel injection system, the throttle valve 80 is arranged to be closed to block the air passage 78 when the acceleration pedal is not depressed.

Additionally, the intake conduit wall 72*a* is formed with upper and lower (in the drawing) auxiliary air passages 82 and 84 each of which bypasses the throttle valve 80. Accordingly, one end of each auxiliary passage 82, 84 opens to the intake passageway 78 upstream of the throttle valve 80, while the other end of the same passage opens to the intake passageway 78 downstream of the throttle valve 80. Upper and lower adjustment screws 86 and 88 are disposed in the upper and lower auxiliary air passages 82 and 84 to change the effective air flow area of the upper and lower auxiliary air passages 82 and 84, respectively. An electromagnetic valve 90 is operatively disposed in the lower auxiliary air passage 84 so as to be capable of blocking the lower auxiliary air passage 84. It is to be noted that the totalled sectional area of the upper and lower auxiliary air passages 82 and 84 is so set as to supply the engine with air which causes the engine speed at idling to be at a higher predetermined engine speed than the idling engine speed in a vehicle equipped with a manual transmission. Accordingly, air to be supplied to the engine is controlled to maintain an idling engine speed which is approximately the same as in the vehicle equipped with the manual transmission. The electromagnetic valve 84 is normally open and arranged to be close to block the lower auxiliary air passage 84 when the solenoid 90*a* of the electromagnetic valve 90 is supplied with electric current to be energized. A terminal of the solenoid 90*a* is grounded through the ignition switch 40 and the electric source 42, while the other terminal of the solenoid 90*a* is grounded through the temperature switch 44, the gear range switch 60 and the cranking switch 62.

With the thus arranged engine control system, during idling or only in case where the engine coolant temperature is not lower than the predetermined level and the automatic transmission is in the non-drive range, the temperature switch 44 and the gear range switch 60 are both close, thereby causing the electromagnetic valve 90 to be close so as to block the lower auxiliary air passage 84. Accordingly, the engine is supplied with air passed through the upper auxiliary air passage 82, so that the idling engine speed becomes of approximately the same level as in the vehicle equipped with the manual transmission. When at least one of the temperature switch 44 and the gear range switch 60 is open under the condition where the engine coolant temperature is below the predetermined level and/or the automatic transmission is in the drive range, the solenoid 90*a* is de-energized to open the lower auxiliary air passage 84. As a result, even during idling where the intake air passageway 78 formed in the intake conduit 72 is blocked by the throttle valve 80, the engine is supplied with air-fuel mixture containing air passed through the upper and lower auxiliary air passages 82, 84, thus increasing the engine speed at idling. Furthermore, during engine starting, the contactor of the cranking switch 62 becomes open and consequently the lower auxiliary air passage 84 becomes open, thereby facilitating engine starting.

As is appreciated from the above, with the embodiment of FIG. 3 or 4, under the condition where the automatic transmission is in the non-drive range, the engine speed at idling is lowered and the amount of fuel consumed at idling is decreased while reducing engine noise under this condition. Additionally, since the engine control system is so arranged to prevent idling engine speed from lowering, the idling engine speed becomes higher in case where engine warming-up operation is insufficient, thus preventing occurrence of engine halt.

What is claimed is:

1. A control system for an internal combustion engine of a vehicle equipped with an accelerator pedal and an automatic transmission, comprising:

means for detecting one of an engine speed and a vehicle speed not lower than a predetermined level;

means for detecting an engine temperature not lower than a predetermined level;

means for decreasing the amount of air to be supplied to the engine by a predetermined amount during release of said accelerator pedal and only in response to (1) said one detected speed and (2) said engine temperature being both not lower than said respective predetermined levels; and wherein said vehicle has a throttle valve controlled by the accelerator pedal and wherein the air amount decreasing mean includes throttle regulating means operative for placing the fully closed position of the throttle valve in a first state when at least one of said detected speeds is lower than said predetermined level and said engine temperature is lower than said predetermined level, and a second state when at least one of said detected speeds is not lower than said predetermined level and said engine temperature is not lower than said predetermined level, the valve opening degree of said second state being smaller than that of said first state.

2. A control system as claimed in claim 1, wherein said throttle regulating means includes a vacuum actuator having a movable push rod which is contactable with a lever fixedly connected to the throttle valve, said push rod taking its first state to put the throttle valve into said first state of the fully closed position when supplied with vacuum while taking its second state to put the throttle valve into said second state of the fully closed position when supplied with atmospheric air.

3. A control system as claimed in claim 2, wherein said vehicle speed detecting means includes a vehicle speed switch which is open when said vehicle speed is not lower than said predetermined level, and said engine temperature detecting means includes an engine temperature switch which is open when said engine temperature is not lower than said predetermined level.

4. A control system as claimed in claim 3, wherein said throttle regulating means includes a vacuum control valve for supplying atmospheric air to said vacuum actuator in response to the open condition of both said vehicle speed switch and said engine temperature switch.

5. A control system as claimed in claim 4, wherein said vacuum actuator includes first and second diaphragms which are located spaced from each other to define therebetween a vacuum chamber to be supplied with one of vacuum and atmospheric air, said second diaphragm being larger in pressure receiving area than said first diaphragm and located farther from said lever than said first diaphragm, said push rod being fixedly connected to said first and second diagphragms.

6. A control system as claimed in claim 5, wherein said vacuum actuator includes a spring for urging said first diaphragm in the direction far from said lever.

7. A control system as claimed in claim 6, wherein said vacuum control valve is an electromagnetic valve which is fluidly connected to the vacuum chamber of said vacuum actuator and electrically connected to said vehicle speed switch and said engine temperature switch, said electromagnetic valve causing atmospheric air to be supplied to the vacuum chamber of said vacuum actuator when de-energized in response to the open condition of said vehicle speed switch and said temperature switch.

8. A control system as claimed in claim 2, wherein said engine speed detecting means includes an engine speed switch which is open when engine speed is not lower than a predetermined level corresponding to said predetermined engine speed level.

9. A control system as recited in claim 3 wherein said vehicle speed switch and said engine temperature switch are connected in parallel to said throttle regulating means.

10. A control system as recited in claim 7 wherein said vehicle speed switch and said vehicle temperature switch are connected in parallel to said electromagnetic valve.

* * * * *